US006860462B2

(12) United States Patent
Vappula

(10) Patent No.: US 6,860,462 B2
(45) Date of Patent: Mar. 1, 2005

(54) CLAMPING ARRANGEMENT FOR CASTING MOLD SIDEWALLS

(75) Inventor: Kari Vappula, Toijala (FI)

(73) Assignee: Consolis Technology OY AB, Vantaa (FI)

( * ) Notice: Subject to any disclaimer, the term of this patent is extended or adjusted under 35 U.S.C. 154(b) by 15 days.

(21) Appl. No.: 10/353,032

(22) Filed: Jan. 29, 2003

(65) Prior Publication Data

US 2003/0146367 A1 Aug. 7, 2003

(30) Foreign Application Priority Data

Feb. 4, 2002 (FI) ..... 20020043 U

(51) Int. Cl.[7] ..... B28B 7/26
(52) U.S. Cl. ..... 249/139; 249/205
(58) Field of Search ..... 249/120, 139, 249/167, 168, 205, 219.1, 160, 163, 165, 166; 425/3, DIG. 33

(56) References Cited

U.S. PATENT DOCUMENTS 4,280,677 A * 7/1981 Shahar ..... 249/43
4,768,748 A * 9/1988 Leimkuhler et al. ..... 425/3
6,082,701 A 7/2000 Reymann

FOREIGN PATENT DOCUMENTS

| | | | |
|---|---|---|---|
| DE | 4327696 | * | 2/1995 |
| DE | 199 61 062 | | 6/2001 |
| EP | 1075917 | * | 2/2001 |
| EP | 1 232 842 A2 | | 8/2002 |

* cited by examiner

*Primary Examiner*—Michael Safavi
(74) *Attorney, Agent, or Firm*—Burns, Doane, Swecker & Mathis, L.L.P.

(57) ABSTRACT

Clamping arrangement for casting mold sidewalls in which arrangement two adjacent sidewalls are clamped to their places by a interlocking plate together with a clamp magnet. The said interlocking plate is formed by a plate element having at its both end locking members adapted to rest against the exterior sides of said sidewalls and said locking members being aligned to project in opposite directions at the ends of said interlocking plate.

4 Claims, 3 Drawing Sheets

CLAMPING ARRANGEMENT FOR CASTING MOLD SIDEWALLS

The present invention relates to the clamping of concrete casting mold sidewalls on a casting bed. More particularly, the invention relates to a dual clamping technique of casting mold sidewalls capable of clamping two sidewalls by means of a single clamp magnet.

When modular building panels are to be cast from a concrete mix, casting is generally performed onto a planar-bottom casting mold known as a casting bed, or tipping bed, that is equipped with sidewalls. The casting machine travels above the bed and meters concrete mix into the mold. After the cast object is cured, the bed is tipped about an axis of rotation aligned at its one edge into an almost vertical position, the sidewall thus becoming the top side of the mold is removed and the cast object is elevated away from the casting bed by eyelets provided at its sides.

The use of clamp magnets for attaching dismountable sidewalls of a casting mold is already known in the art, wherein they are most appropriate for attaching a sidewall by adhering to the smooth steel surface of the casting bed. To achieve secure clamping of the sidewall, strong magnets must be used to attain a clamping force of, e.g., 15 kN. One example of an embodiment based on the use a clamp magnet is disclosed in FI utility model no. 4258.

When plural concrete products are to be cast in a single run, the goal is to utilize the entire castable surface area of the casting bed maximally effectively, whereby it is necessary to place the sidewalls of the adjacent casting molds as close as possible to each other.

However, a close disposition of the sidewalls to each other is complicated by the length of the sidewall clamp magnets and the extra space required by the magnet clamp/release tools behind the magnet. Moreover, prior art arrangements have needed an individual clamp magnet for each one of the sidewalls. As a result, the sidewalls must have been outdistanced from each other, whereby unused space remains on the casting bed and the number of clamp magnets placed thereon is increased.

Accordingly, the invention concerns a damping arrangement for interlocking sidewalls of a casting mold. The interlocking arrangement according to the invention makes it possible to attach two sidewall elements using a single magnet only, whereby the waste space remaining between the wall elements is reduced to the width of the clamp magnet. Moreover, a sufficient space for operation with the clamp/release tool is left in the lateral direction of the sidewalls.

The clamping of the sidewalls takes place by means of an interlocking plate aligned at perpendicular angles to the sidewalls. Either end of the interlocking is provided with locking members by means of which the interlocking plate simultaneously both locks itself and becomes wedged into clamping slots made on the exterior surface of the sidewalls. The middle portion of the interlocking plate is provided with magnet clamping members which project slightly outward from the interlocking plate surface and on which the clamp magnet is lowered. As the magnet adheres to the casting bed and thus engages with its clamping members, the clamping force of the magnet is transmitted via the interlocking plate to both its locking members that in turn impose a downward pressing force on the casting mold sidewalls, whereby a single magnet suffices to clamp both ones of two adjacent sidewalls in a casting mold. This arrangement allows the number of magnets required in the assembly of a casting mold to be reduced in half as compared with the number of magnets in a conventional clamping arrangement of casting mold sidewalls.

The locking members mounted at the end of the interlocking plate are shaped so that the interlocking plate can be removed from the space between the sidewalls without moving the sidewalls. This dismounting operation takes place by way of elevating the interlocking plate slightly, whereby the locking members disengage from the locking slots of the casting mold sidewalls, whereupon the interlocking plate can be removed by first rotating the interlocking plate in the space remaining between the casting mold sidewalls. This arrangement facilitates the removal of the sidewalls after the cast object is cured.

Next, the invention will be examined in greater detail by making reference to the attached drawings, wherein FIG. 1A shows the structure of an interlocking plate according to the invention;

Figure 1A:
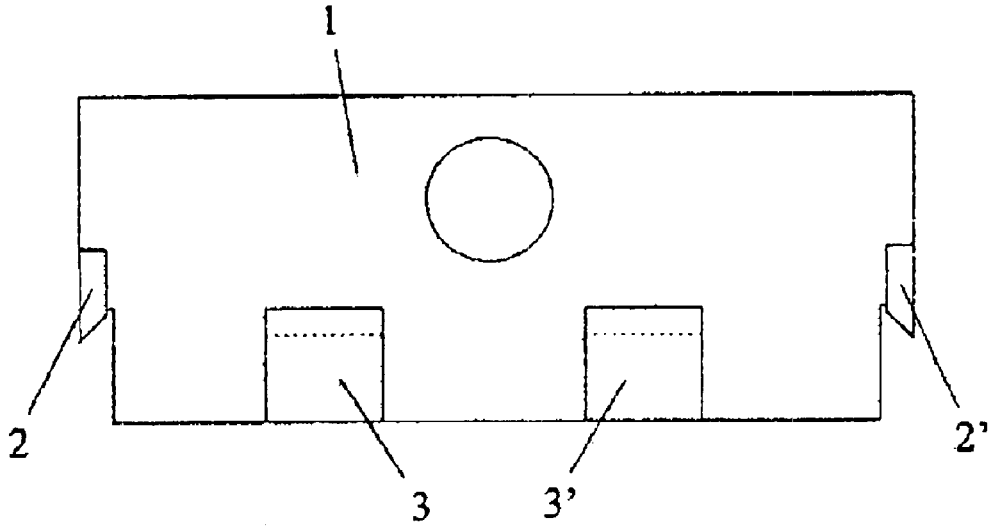
FIG. 1B shows a sidewall view of the structure of the interlocking plate according to the invention.
Figure 1B:
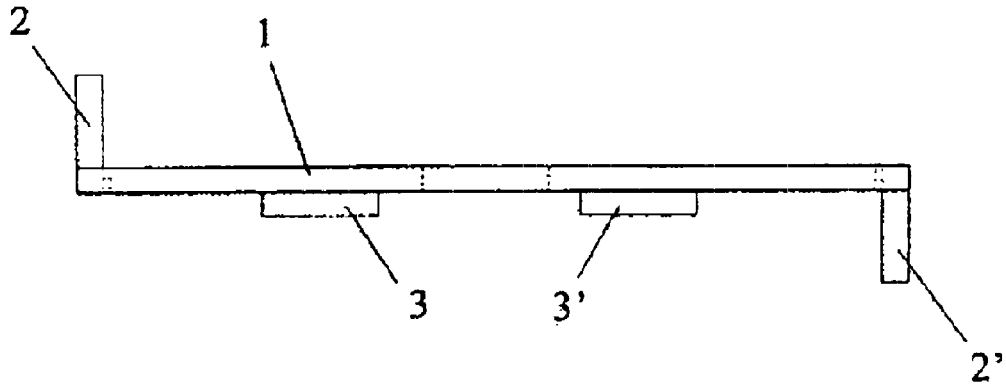

Referring to FIGS. 1A AND 1B, the construction of the interlocking plate according to the invention shown therein comprises a plate element 1, lateral winged locking members 2, 2' and magnet clamping members 3, 3'.

As the interlocking plate is inserted into the space between the adjacent sidewalls of the casting mold, the wedged undersides of the winged locking members 2, 2' slidably remain resting on the compatible counterwedged surfaces provided on the exterior surfaces of the casting mold sidewalls thus locking the walls to the interlocking plate in a rigid fashion. The magnet is connected to the interlocking plate via wedged surfaces made on the top edges of the magnet clamping members 3, 3' that mate with compatible counterwedged surfaces made on the wide side of the magnet. As the magnet adheres to the casting bed, also the casting mold sidewalls become firmly secured in place by the force transmitted over the interlocking plate.

Figure 2:
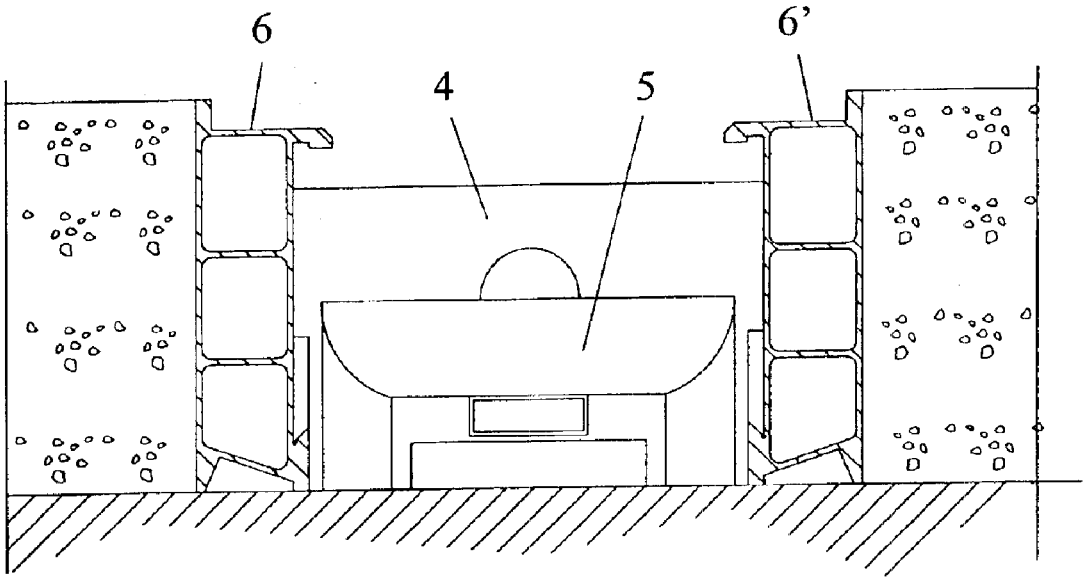
FIG. 2 shows the interlocking plate according to the invention mounted in place.

In FIG. 2 is shown the interlocking plate according to the invention mounted in service. Herein, the interlocking plate 4 is clamped in place by means of a magnet 5. The force of magnetic attraction is transmitted via the interlocking plate to the casting mold sidewalls 6, 6'. To dismount the casting mold, a magnet release tool can be readily hooked to the top of the magnet in order to detach the magnet from the casting bed.

Figure 3:
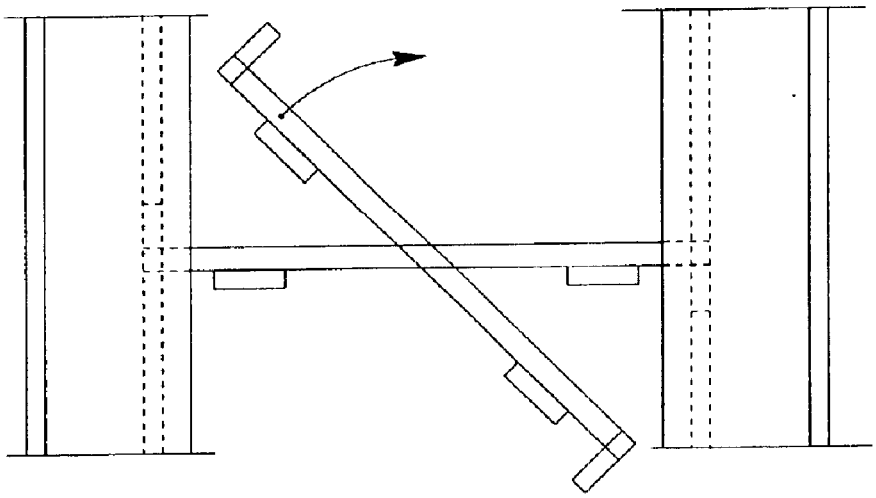
FIG. 3 shows a preferred technique of dismounting the interlocking plate according to the invention.

In FIG. 3 is shown a preferred technique of dismounting the interlocking plate according to the invention. After the cast object is cured so that the casting mold sidewalls can be removed, the magnet is removed first, whereupon the interlocking plate is elevated so much that the wedged surfaces of the winged locking members are freed from the counterwedged locking slots located on the exterior surfaces of the casting mold sidewalls. Subsequently, the interlocking plate can be removed by first rotating the interlocking plate in the direction of the wing-like locking members and then elevating the interlocking plate away from the space between the casting mold sidewalls, thus making it possible to move the adjacent sidewalls toward each other and lift them away from the sides of cast object.

Figure 4:
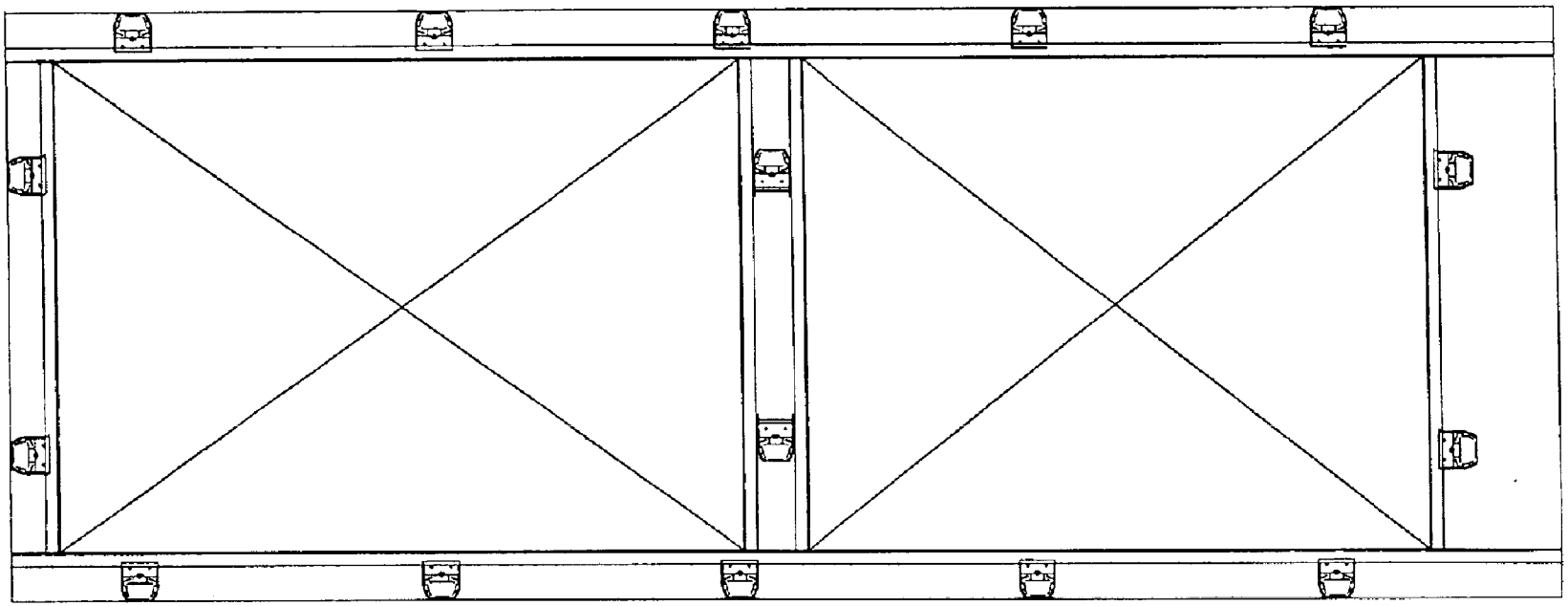
FIG. 4 shows an exemplary casting mold layout utilizing the interlocking plate according to the invention.

In FIG. 4 is shown an exemplary casting mold layout utilizing the interlocking plate according to the invention in the space remaining between the adjacent sidewalls of the casting mold.

While the attachment of a clamp magnet to the interlocking plate according to the invention is not limited to any specific locking technique, an advantageous way is to use a connection formed between a wedged surface and a counterwedged surface such as that shown in the diagrams. This kind of a connection between a wedged and a counterwedged surface is also disclosed FI utility model nos. 4258 and 4973. An essential feature of the present interlocking arrangement is to provide a secure attachment of the magnet to the interlocking plate so as to clamp the interlocking plate in place along with the attraction force of the magnet.

The same notice can be made in regard to the joints between the interlocking plate and the exterior surfaces of the casting mold sidewalls.

What is claimed is:

1. A clamping arrangement for the sidewalls of a concrete casting mold, the clamping arrangement comprising an interlocking plate connecting two adjacent sidewalls of casting mold with each other and a clamp magnet, wherein said interlocking plate connecting said two adjacent sidewalls to each other is formed by a plate element having at its both ends locking members adapted to rest against the exterior sides of said two adjacent sidewalls, said locking members being aligned to project in opposite directions at the ends of said interlocking plate.

2. The clamping arrangement of claim 1, wherein said plate element of said interlocking plate connecting the two adjacent sidewalls to each other is provided on at least one of its vertical sides with a projection having a wedged top edge that is adapted to fit into a compatibly counterwedged slot provided on the vertical side surface of said clamp magnet.

3. The clamping arrangement of claim 1, wherein said locking members of said interlocking plate adapted to rest against said sidewalls of said casting mold are provided with wedged surfaces adapted to mate with the compatibly counterwedged locking surfaces of locking slots provided at the exterior sides of the sidewalls.

4. The clamping arrangement of claim 2, wherein said locking members of said interlocking plate adapted to rest against said sidewalls of said casting mold are provided with wedged surfaces adapted to mate with the compatibly counterwedged locking surfaces of locking slots provided at the exterior sides of the sidewalls.

* * * * *